United States Patent [19]

Benedetto

[11] 4,445,987

[45] May 1, 1984

[54] ELECTROLYTIC PURIFICATION AND RECONCENTRATION OF WASH AND RINSE CAUSTIC SOLUTIONS RECOVERED FROM THE REGENERATION OF ION EXCHANGE RESINS

[75] Inventor: Enrico Benedetto, Domodossola, Italy

[73] Assignee: Oronzio de Nora S.A., Lugano, Switzerland

[21] Appl. No.: 480,618

[22] Filed: Mar. 30, 1983

[51] Int. Cl.[3] ..... C25B 1/16; C25B 1/00; C02F 1/46

[52] U.S. Cl. ..... 204/98; 204/128; 204/151

[58] Field of Search ..... 204/98, 128, 151

[56] References Cited

U.S. PATENT DOCUMENTS

| | | | |
|---|---|---|---|
| 3,681,214 | 8/1972 | Ionescu et al. | 204/98 |
| 4,078,978 | 3/1972 | Zirniebl | 204/98 |
| 4,202,743 | 5/1980 | Oda et al. | 204/98 |
| 4,260,463 | 4/1981 | Rideout | 204/98 |

*Primary Examiner*—R. L. Andrews
*Assistant Examiner*—Terryence Chapman
*Attorney, Agent, or Firm*—Pollock, Vande Sande & Priddy

[57] ABSTRACT

Diluted and contaminated caustic solutions coming from the regeneration and washing of ion exchange resins may advantageously be purified and reconcentrated to be reused during the subsequent regeneration cycles, by subjecting the contaminated solution to electrolysis in the anodic compartment of an electrolytic cell provided with a cation-exchange membrane and recovering concentrated and purified caustic solution from the cathodic compartment of the cell, whereto demineralized water is fed.

The process of the invention may advantageously be carried out in subsequent electrolytic stages in order to maintain optimum working conditions and a high overall efficiency of the process.

11 Claims, No Drawings

ELECTROLYTIC PURIFICATION AND RECONCENTRATION OF WASH AND RINSE CAUSTIC SOLUTIONS RECOVERED FROM THE REGENERATION OF ION EXCHANGE RESINS

FIELD OF THE INVENTION

The present invention is concerned with an electrolytic process for the purification and reconcentration of caustic soda solutions recovered from the regeneration of anion exchange resins.

BACKGROUND OF THE INVENTION

The bed of particles of ion exchange resin in plants for the demineralization of water, of salt solutions or of other types of solutions such as halogenated organic solutions, which utilize anion exchange resins, has to be regenerated after a certain period of operation in order to remove the impurities, consisting of anion groups sequestered by the resin and thus to restore the adsorption capacity of the bed.

The regeneration process consists essentially of a washing stage wherein a solution containing from 150 gr/l to 60–70 gr/l of caustic soda, depending on the type of anion exchange resin, is flown countercurrent through the bed, to obtain the maximum expansion of the bed, for the time necessary to regenerate completely the adsorption capacity of the resin. This is followed by a short rinsing stage, with water, for one or more minutes in order to remove the caustic soda from the circuit before re-starting normal operation.

The regeneration solution as well as the rinsing water are obviously contaminated by the impurities removed from the resin and therefore cannot be re-utilized further but have to be neutralized and diluted in order to be discharged in accordance to the pollution control regulations. This accounts for a significant portion of the expenditure for the maintenance of the demineralization plant and anyway it always constitutes a potential risk of pollution.

OBJECTS OF THE INVENTION

It is therefore the main object of the present invention to provide a process for the purification and reconcentration of the caustic soda solution effluent from the regeneration and rinsing stages, in order to allow re-utilization of the purified and re-concentrated caustic soda solution with a minimum of caustic solution needing to be discharged after every regeneration treatment.

GENERAL AND DETAILED DESCRIPTION OF THE INVENTION

The process of the present invention consists of electrolyzing the contaminated caustic soda solution in one or more electrolysis cells provided with an anodic compartment containing an anode and a cathodic compartment containing a cathode, separated by a ion exchange resin membrane permeable to cations and substantially impervious to the hydrodynamic flow of fluids.

The contaminated caustic solution recovered as effluent from the regeneration and rinsing stages, is circulated through the anodic compartment of the cell, while demineralized water is suitably fed to the cathodic compartment.

The electrolysis current impressed to the cell gives rise to oxygen evolution at the anode, sodium ions migration through the membrane and hydrogen evolution at the cathode.

Therefore, the concentration of caustic soda in the anodic solution decreases while the concentration of caustic soda in the catholyte increases during the electrolytic process. The impurities contained in the contaminated caustic solution fed to the anodic compartment, which generally are constituted by anions such as $Cl^-$, $SO_4^{--}$, $Br^-$, $I^-$, remain in the anolyte because the cation exchange membrane acts as a barrier preventing their diffusion to the catholyte.

Therefore, the caustic solution recovered from the cathodic compartment together with the hydrogen produced is reconcentrated to the desired value and is essentially free from contaminants and thus may be re-used during the next cycle of regeneration of the anion exchange resins.

The treatment of the contaminated caustic solution may be carried forth to obtain a reduction of the residual caustic soda content to 1–2 gr/l. This residual solution containing all the contaminating anion species constitutes the waste of every regeneration treatment and in practice corresponds to about the 4% of the caustic soda recovered after every washing stage.

According to a preferred embodiment of the present invention, the contaminated caustic solution is subjected to a cascade treatment, firstly in an electrolysis cell operating at high current density, which may be comprised between 1500 and 3000 $A/m^2$ to reduce the caustic soda content to about 15–10 gr/l. The solution released from the anodic compartment of the first cell is then fed to the anodic compartment of a second cell operating at a lower current density, which may be comprised between 1000 and 500 $A/m^2$, to reduce the caustic soda content to about 1–2 gr/l.

This staging of the electrolytic treatment of the contaminated caustic solution allows to keep a relatively low cell voltage both in the first and in the second stage. In fact when the caustic soda concentration in the anolyte is reduced below about 15–10 gr/l, a considerable increase of the cell voltage is observed. Therefore, by carrying out the final stage of the electrolytic treatment in a cell at low current density, the cell voltage may be kept below about 5 Volts, which may be considered as the maximum cell voltage allowable in order to avoid premature loss of activity of the anodes and damage of the membrane.

The number of stages also may be advantageously increased so that successive electrolytic treatments of the contaminated caustic solution, to reduce the caustic soda content from 15–20 gr/l down to 2–1 gr/l, may be effected each under decreasing densities, for example from 1000 $A/m^2$ step-wise down to 500 $A/m^2$. This may be achieved by providing various cells where to flow the anodic solution in cascade or by suitably varying the current load during the final stage of the treatment, if a single cell is utilized.

Obviously, also the catholyte may be flown in cascade from one cell to the other, but it has been found more efficient to maintain the same caustic soda concentration in the catholyte of all the cells utilized by feeding to every cathode compartment demineralized water at a rate suitable to obtain the desired concentration of caustic soda at the outlets of the cathodic compartments, that is in the range between 100 and 200 gr/l.

In case a batch type treatment of the contaminated caustic solution is envisaged, instead of a continuous operation, it is not required to have several cells at disposal but the same staging of the electrolytic treatment for the purification and reconcentration of the caustic solution may be conveniently done utilizing a single electrolysis cell by suitably decreasing the current load during the successive stages of the electrolytic treatment.

In order to better illustrate the invention, a practical example of a preferred embodiment is reported herewith. The characteristics and the working conditions of the cell however, are simply illustrative and must not be intended as a limitation of the invention claimed hereby.

EXAMPLE

The electrolysis cell utilized for the test had an electrodic surface of 25 $dm^2$.

The anode was constituted by an expanded titanium sheet having an original thickness of 1.5 mm, coated with a deposit of about 30 $gr/m^2$ of mixed oxides of titanium, ruthenium and iridium in the following ratio by weight 1:1:0.1.

The cathode was constituted by a nickel expanded sheet having an original thickness of 1.5 mm.

The membrane used was a film of a hydrolyzed copolymer of tetrafluoroethylene and a fluorosulphonated perfluorovinyl ether, produced by E. I. Du Pont de Nemours & Co. under the trade name of Nafion 324.

The contaminated and diluted caustic solution to be treated and which was recovered from the washing and rinsing of a column of anion exchange resin, had the following characteristics:

NaOH 50 gr/l
NaCl 2–3 gr/l
$H_2SO_4$ traces.

1st Stage

The contaminated caustic solution was circulated by means of a pump through the anodic compartment of the cell and demineralized water was fed to the cathodic compartment at a suitable flow rate.

The working conditions were as follows:

| | |
|---|---|
| anolyte temperature | 50–60° C. |
| current density (constant) | 2000 $A/m^2$ |
| caustic soda concentration in the catholyte (caustic soda continuously recovered from the cathodic compartment) | 150 g/l |

Eletrolytic has been protracted at these conditions until the caustic soda concentration in the caustic solution circulated in the anodic compartment has been reduced to 12 gr/l. The cell voltage which was initially 3.3 V constantly increased to reach 4 V, at the end of this first stage of the treatment.

2nd Stage

In order to further reduce the caustic soda concentration in the contaminated solution (anolyte), electrolysis has been continued at gradually decreased current densities in order to keep the cell voltage at about 5 V.

The working conditions of this second stage were as follows:

| | |
|---|---|
| anolyte temperature | 50° C. |
| current density (decreasing) | from 1000 to 500 $A/m^2$ |
| caustic soda concentration in the catholyte (caustic soda continuously recovered from the cathodic compartment) | 150 gr/l |
| cell voltage (constant) | 5 V. |

Electrolysis has been protracted until the caustic soda concentration in the anolyte had decreased to below 2 gr/l.

Samples of the purified and reconcentrated caustic soda recovered from the cathodic compartment of the cell collected during both treatment stages were analyzed and the results were as follows:

NaOH 150 gr/l
NaCl 150 ppm
$NaSO_4$ nil.

The specific electric energy consumption resulted of about 3.5 kWh per kg of purified NaOH recovered from the catholyte of the cell.

By products of the process were:

280 lt of hydrogen per kg of purified NaOH
140 lt of oxygen per kg of purified NaOH.

I claim:

1. An electrolytic process for the purification of contaminated caustic solutions which comprises feeding the contaminated caustic solution to the anodic composition of an electrolysis cell separated from the cathodic compartment by a cation exchange membrane; feeding demineralized water to said cathodic compartment; recovering purified caustic solution from said cathodic compartment; conducting the electrolysis at a current density between 1500 and 3000 ampere per square meter until the caustic concentration in the anolyte is reduced to a value not lower than 10 grams per liter; and conducting the electrolysis at a current density between 1000 and 500 ampere per square meter to further reduce the caustic concentration in the anolyte to below 2 grams per liter while maintaining the caustic concentration constant in the catholyte by regulating the rate of feeding of the demineralized water to said cathode compartment.

2. The process of claim 1 characterized in that the caustic concentration in the catholyte is kept constant and within the range between 100 and 200 gr/l by regulating the demineralized water feed rate.

3. The electrolytic process of claim 1 which further comprises conducting the electrolysis in at least two electrolysis cells, passing the contaminated caustic solution in cascade through the anode compartments of said cells starting from the cell operating at a higher current density through to the cell operating at the lowest current density, and discharging the contaminated caustic solution having a residual caustic concentration of less than 2 grams per liter from said cell operating at the lowest current density.

4. The process of claim 3 characterized in that the caustic concentration in the catholyte is kept constant and within the range between 100 and 200 gr/l by regulating the demineralized water feed rate.

5. The process of claim 3 wherein the cell voltage is below about 5 volts.

6. The process of claim 3 wherein the caustic concentration in the anolyte is reduced to a value of 15 to 10 grams per liter in the electrolysis conducted at a current density between 1500 and 3000 ampere per square meter; and to a value of 1 to below 2 grams per liter in the electrolysis conducted at a current density of between 1000 and 500.

7. The process of claim 6 wherein the contaminated caustic solution is from the regeneration of ion exchange resins, the cell voltage is below about 5 volts, and wherein the caustic concentration in the catholyte is kept constant and within the range between 100 and 200 gr/l by regulating the demineralized water feed rate.

8. The process of claim 1 wherein said contaminated caustic solution is from the regeneration of ion exchange resins.

9. The process of claim 1 wherein the cell voltage is below about 5 volts.

10. The process of claim 9 characterized in that the caustic concentration in the catholyte is kept constant and within the range between 100 and 2.0 gr/l by regulating the demineralized water feed rate.

11. The process of claim 1 wherein the caustic concentration in the anolyte is reduced to a value of 15 to 10 grams per liter in the electrolysis conducted at a current density between 1500 and 3000 ampere per square meter; and to a value of 1 to below 2 grams per liter in the electrolysis conducted at a current density of between 1000 and 500.

* * * * *